United States Patent [19]

Terzian

[11] 4,124,952

[45] Nov. 14, 1978

[54] ARTICULATED DOLL

[75] Inventor: Rouben T. Terzian, Chicago, Ill.

[73] Assignee: Marvin Glass & Associates, Chicago, Ill.

[21] Appl. No.: 767,391

[22] Filed: Feb. 14, 1977

[51] Int. Cl.[2] ..... A63H 29/16

[52] U.S. Cl. ..... 46/44; 46/120; 46/141; 46/171

[58] Field of Search ..... 46/44, 116, 119, 118, 46/120, 141, 171, 264, 265

[56] References Cited

U.S. PATENT DOCUMENTS

| | | | |
|---|---|---|---|
| 3,153,881 | 10/1964 | Baulard-Cogan | 46/126 |
| 3,594,942 | 7/1971 | Hollingsworth | 46/44 |
| 3,722,136 | 3/1973 | Thorn et al. | 46/120 X |
| 3,740,893 | 6/1973 | Shinoda | 46/44 |
| 3,959,919 | 6/1976 | Baulard-Cogan | 46/135 R |

*Primary Examiner*—Russell R. Kinsey
*Assistant Examiner*—Mickey Yu
*Attorney, Agent, or Firm*—Mason, Kolehmainen, Rathburn & Wyss

[57] ABSTRACT

An articulated doll with movable arms capable of moving one arm in an up and down fashion to simulate the answering of a phone. The second arm is movable in a side-to-side motion so that a utensil such as a toothbrush held by the second hand is moved to simulate the brushing of teeth. The arms are moved in response to mechanical stimuli actuated by squeezing various portions or extremities of the doll. In one arrangement a pair of independently operable squeeze bulbs are located on one foot of the doll and are each in communication with a corresponding bellows mounted adajcent each of the shoulder joints of the doll. Expansion of the bellows acts through pivotable or rotatable members to move the arms as described. Additional squeeze bulbs are located in the second foot of the doll to independently control the opening and closing of the doll's mouth and the intake of liquid through a mouth opening.

23 Claims, 8 Drawing Figures

Fig 1
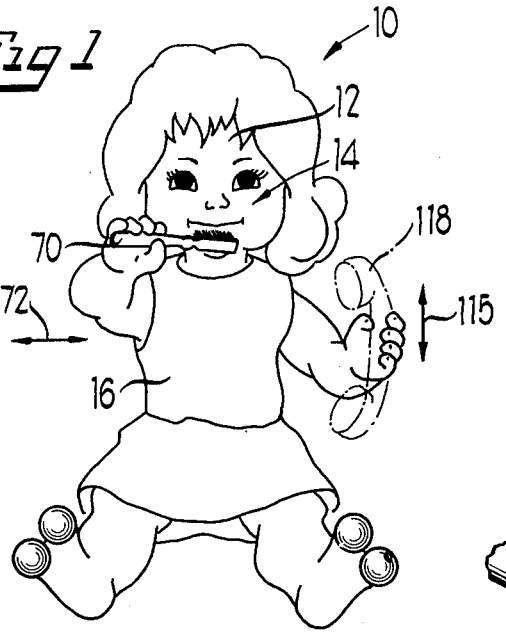
Fig 7
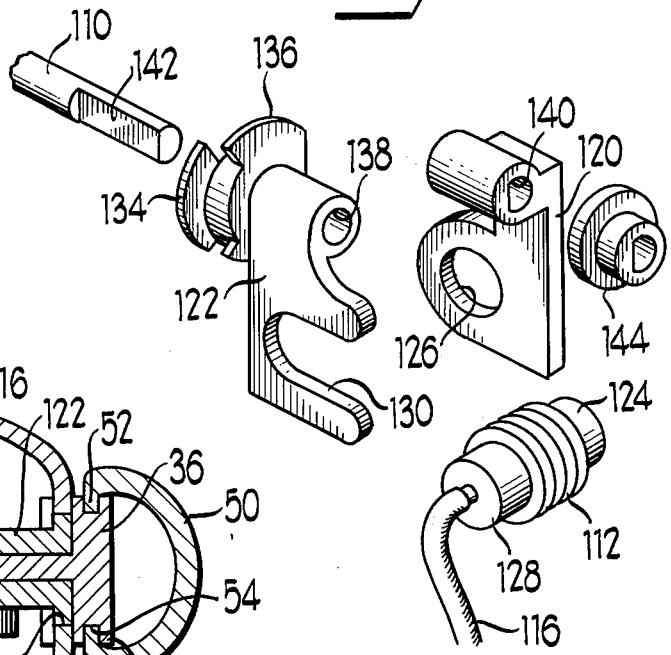
Fig 5
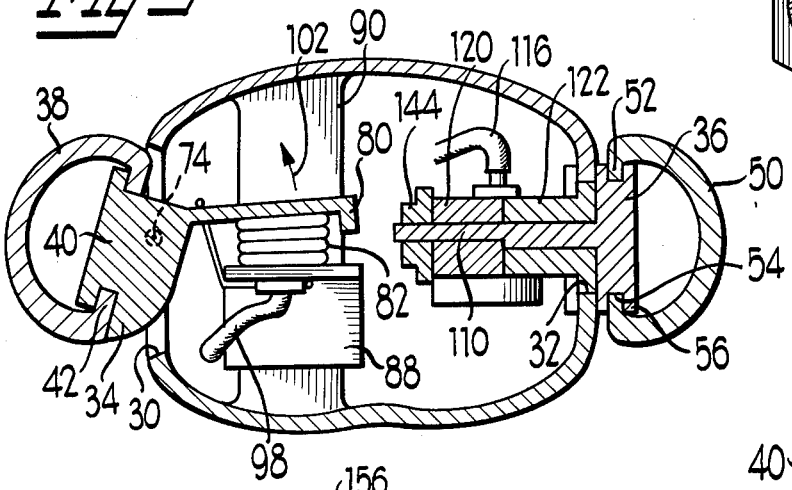
Fig 6
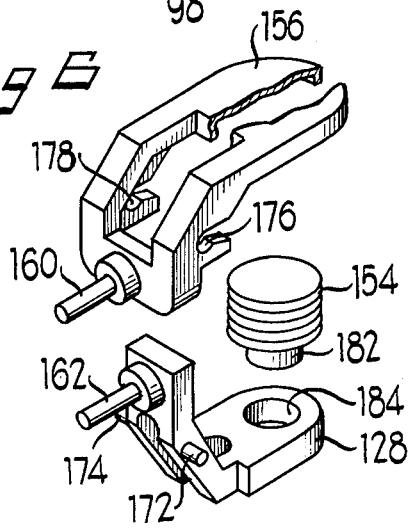
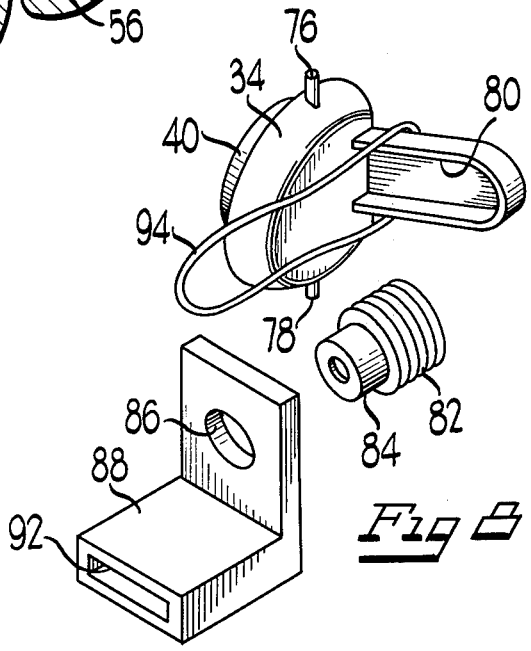
Fig 8

ARTICULATED DOLL

BACKGROUND OF THE INVENTION

This invention relates to articulated dolls and more particularly to a doll with arms capable of moving to perform various functions such as lifting a telephone receiver to the ear with a first arm or brushing the teeth with a second arm. This invention further relates to a doll having a mouth capable of being operated to open and close and a mouth opening through which the intake of liquid is accomplished.

Articulated dolls which are capable of various movements and operations by means of air or fluid being pumped to move portions of the doll or to pump out fluids from the doll such as to cause tears to flow from the eyes of the doll are disclosed in U.S. Pat. No. 3,757,463 which issued to J. D. Breslow et al on Sept. 11, 1973 and in pending application Ser. No. 655,621 filed by R. T. Terzian on Feb. 5, 1976 and assigned to the same assignee as the present application.

There is a continuing need and desire to provide improved forms of activity movable figure toys or dolls which perform movements and functions in response to external stimuli.

SUMMARY OF THE INVENTION

The present invention provides an articulated doll with a torso supporting a head and limb members. At least one arm limb is arranged for movement and a mouth structure is defined on the doll which is capable of being opened and closed.

The arm and the mouth are each operated by the manual compressing of independent squeeze bulbs positioned on the doll structure. Each of the squeeze bulbs is in communication with a respective bellows so that expansion of the bellows acts through pivoting assemblies to either move the arm or close the mouth.

One arm of the doll may be arranged to hold a utensil such as a toothbrush and be movable to emulate a toothbrushing action. A second arm is arranged to rotate in response to another squeeze bulb control arrangement so that the extended arm raises a telephone handset to the head of the doll simulating a telephone answering function. A defined mouth opening is in fluid connection with a squeeze bulb arrangement and is controlled to intake fluids.

In one arrangement, movement of the two arms as described is controlled by a pair of squeeze bulbs which are located in one foot of the doll and the opening and closing of the mouth and the intake of liquids is controlled by two squeeze bulbs located in the other foot of the doll.

BRIEF DESCRIPTION OF THE DRAWINGS

FIG. 1 is a perspective view showing the doll of the present invention and illustrating the arm movements of which the doll is capable;

FIG. 5 is a fragmentary horizontal sectional view, on an enlarged scale, taken from the top of the doll and generally along a horizontal line between the neck and shoulders of the doll illustrating the shoulder and arm assemblies of the doll of FIGS. 1 through 4;

FIG. 6 is an enlarged exploded view of the mouth actuating mechanism;

FIG. 7 is an exploded view, on an enlarged scale, of the mechanism for moving the left arm of the doll; and FIG. 8 is an exploded view, on an enlarged scale, of the mechanism for causing movement of the right arm of the doll.

DESCRIPTION OF THE PREFERRED EMBODIMENT

Figure 2:
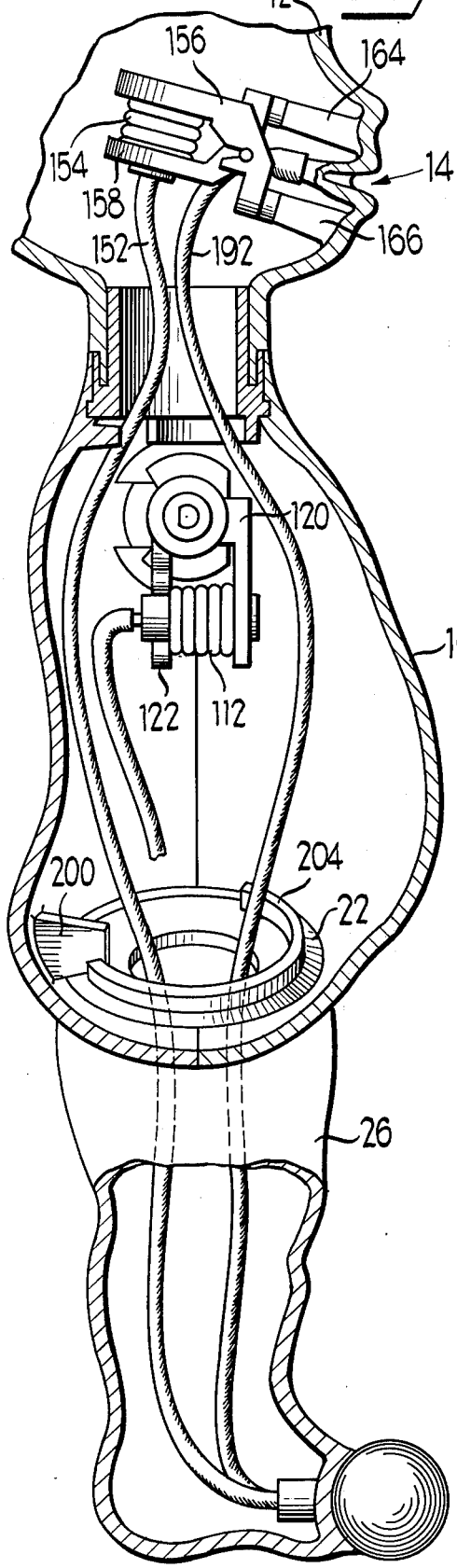
FIG. 2 is a fragmentary cut-away vertical sectional view, on an enlarged scale, of the doll of FIG. 1 taken from the right side of the upstanding doll and generally along a vertical line through the center and along the length of the doll illustrating the features of the left side of the doll.

An articulated doll constructed in accordance with the principles of the present invention, referring to FIG. 1, is generally designated 10 and includes a head 12 having the usual simulated characteristics such as hair, eyes, a nose, ears and a mouth generally designated 14. The head is supported on a torso 16. The torso further has leg openings 18 and 20, referring now to FIGS. 2, 3 and 4, for receiving the flanged ends 22 and 24 of respective right and left legs 26 and 28 whereby the legs are articulated relative to the torso for movement of the aforementioned connection to enable the doll to be positioned in either an upstanding or seated position.

The torso 16 further includes, at its upper end, arm openings 30 and 32 through which a right pivotable shoulder mechanism 34 and a left rotatable shoulder mechanism 36 respectively extend. Both of the shoulder mechanisms 34 and 36 are supported by the torso 16 as will be explained in detail hereinafter.

The right pivotal shoulder mechanism 34 carries a right arm 38 by the interconnection of a flanged end portion 40 of the shoulder mechanism 34 and a flanged end portion 42 of the arm 38. A left arm 50 is carried by the left shoulder mechanism 36 by means of the interconnection of a flanged end portion 52 of the arm 50 within a recess 54 of the shoulder socket mechanism 36 and by means of a flanged end portion 56 of the shoulder mechanism 36.

The interfitting portions of the arms 38 and 50 with the respective shoulder mechanisms 34 and 36 provide for movement of the arms relative to the shoulder mechanisms for positioning of the arms. Each of the arms 38 and 50 have respective simulated hands 60 and 62 which are rotatable in a wrist swivel motion by the interconnection of respective flanged portions 64 and 66 of the arms 38 and 50 with the hands.

In accordance with important aspects of the present invention, the right arm 38 of the doll is arranged to be moved by a pivotal shoulder swivel movement of the shoulder mechanism 34. In one embodiment, the arm is rotated with respect to the shoulder mechanism 34 so that the hand 60 is positioned proximate the face or chin of the doll and a utensil such as a toothbrush 70 is inserted within the hand 60. The hand 60 is arranged in a grasping position and designed to retain various utensils having generally conically shaped handles when inserted into the hand. Upon pivotal shoulder movement of the mechanism 34, the hand 60 and retained toothbrush 70 move across the simulated mouth and teeth of the doll to simulate a toothbrushing action with the hand 60 moving generally in a transverse direction across the expanse of the shoulders or chest of the doll. The movement of the hand 60 and retained toothbrush 70 is shown generally by the direction of the double arrow 72 (FIG. 1).

The shoulder mechanism 34, referring now to FIGS. 5 and 8, is arranged to be pivoted about a pivot point designated 74 by the pivoting of upper and lower extending pins 76 and 78 which are rotatably mounted within the shoulder portions of the torso 16 through the pivot point 74.

A generally U-shaped arm 80 extends from the shoulder mechanism 34 and is positioned against one end of a bellows arrangement 82. The bellows 82 at the end opposite the arm 80 includes a narrowed portion 84 of smaller diameter than the bellows body which is inserted through a passage 86 of a bracket 88. The bracket 88 is fixedly mounted on a support element 90 extending through the inside of the torso 16 by insertion of the bracket 88 onto the support element 90 through a central rectangular cross section passage 92. The arm 80 of the shoulder mechanism 34 is biased toward the bracket 88 by means of an elastic band or urging element 94 which is positioned over the extending arm 80, around one side of the bracket 88 and fastened around the narrowed bellows portion 84.

The bellows arrangement 82 has a spout 96 (FIG. 3) which is inserted into a conduit or flexible conducting tube 98 which extends to a squeeze bulb 100 (FIG. 4) which in a specific embodiment is positioned at the front of the right foot of the doll and in the position of toes. Upon the squeezing of the bulb 100, the bellows 82 expands in a piston or plunger-like fashion to exert force against and pivot the extending arm 80 in a counterclockwise direction as shown in FIG. 5 by the direction arrow 102 to pivot the arm 38 through the shoulder mechanism 34.

In accordance with other important aspects of the present invention, the left arm 50 is rotated through the shoulder mechanism 36, referring now to FIG. 7, through an extending shaft 110 of the shoulder mechanism 36 by means of a bellows arrangement 112. The bellows arrangement 112 is connected to a squeeze bulb 114 (FIG. 4) through a conduit or conducting tube 116. When the bulb 114 is squeezed or compressed, the arm 50 and hand 62 are moved to a raised position to simulate, for example, the answering of a phone or other accessory as indicated by the direction of the double arrow 115 (FIG. 1). The phone receiver or handset 118 is retained within the hand 62 and is raised to the head of the doll 10.

The bellows 112 is arranged to interfit between a rotational drive element 120 and a stationary support element 122. The bellows 112 is positioned by means of a narrowed end portion 124 through a receiving passage 126 of the rotational element 120 and a narrowed end portion 128 into a slot 130 of the stationary support element 122.

Figure 4:
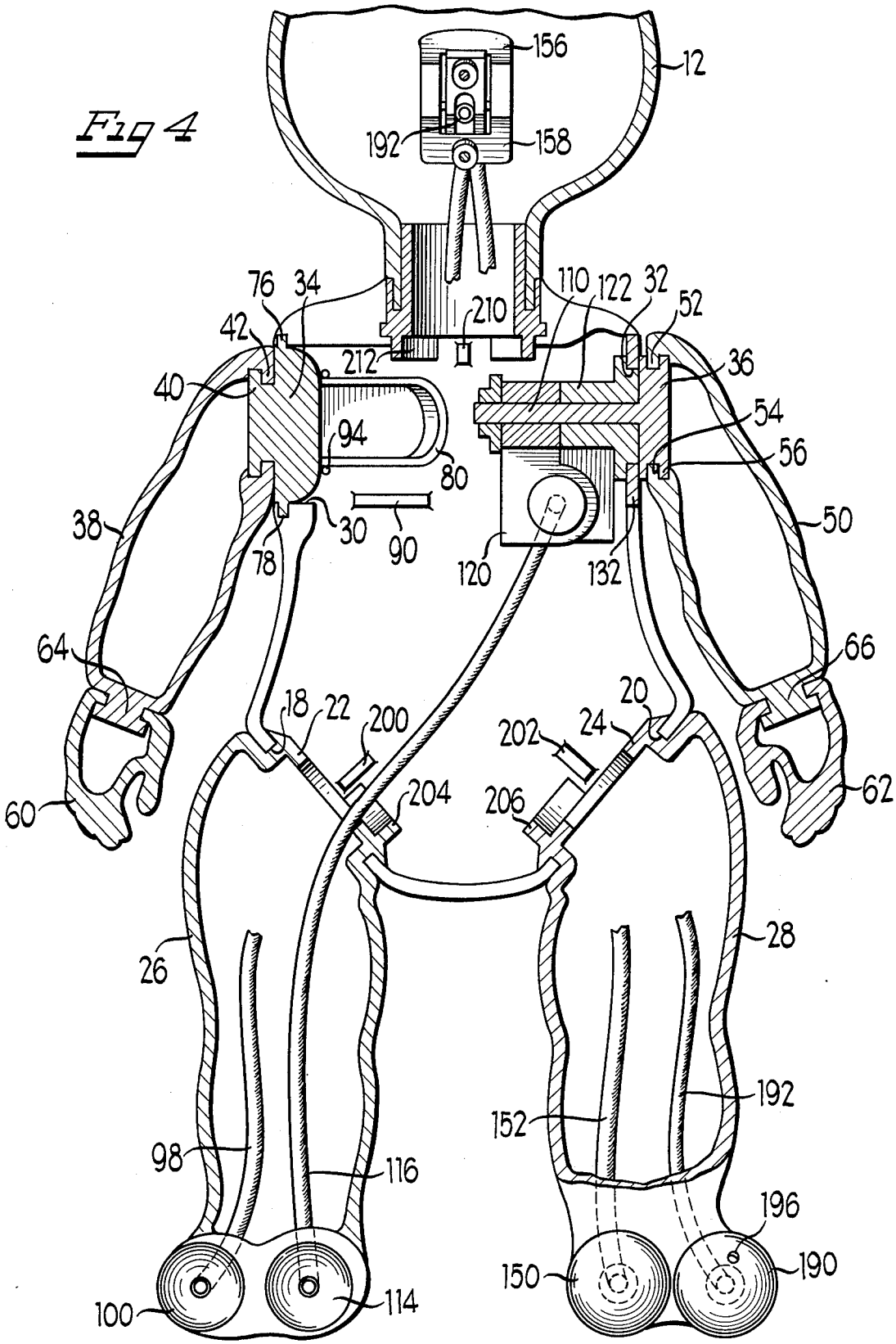
FIG. 4 is a fragmented cut-away vertical sectional view, on an enlarged scale, of the doll of FIG. 1 in an upstanding position taken from the front of the doll and generally along a line through the center and along the length of the doll.

The support element 122, referring now to FIG. 4, is retained by a circular flanged shoulder portion 132 of the torso 16 when interlocked with the mating flange portions 134 and 136 of the support element 122. The extending shaft 110 is positioned through a central passage 138 of the support element 122 so as to be rotatable relative to the support element 122. A keyed passageway or key way 140 is formed at the top of the rotational element 120 and is dimensioned to interfit with a mating slotted portion 142 of the shaft 110 so that the shaft is fixed and rotatable with the rotational element 120. A cap or nut element 144 having a central key way is inserted over the portion 142 of the shaft 110 which extends through the rotational element 120.

Upon the compression of the squeeze bulb 114, the bellows 112 expands against the support element 122 and rotates the element 120 and the attached extending shaft 110 thereby rotating the shoulder mechanism 36 and attached arm 50 to an upper raised position. When the squeeze bulb 114 is released or relieved, the arm 50 will be lowered to the at-rest position at the side of the doll as the bellows 112 contracts.

The mouth 14 of the doll 10 in accordance with yet further aspects of the present invention and referring to FIG. 6 is arranged to be opened and closed as a squeeze bulb 150 (FIG. 4) located in the toe position of the left foot of the doll is compressed and released. The squeeze bulb 150 is operably connected through a conduit or connecting conducting tube 152 to a bellows arrangement 154. The bellows 154 is arranged between a pivoted scissors arrangement formed by interlocking pivotal members 156 and 158 which respectively carry mouth or lip actuators 160 and 162.

Figure 3:
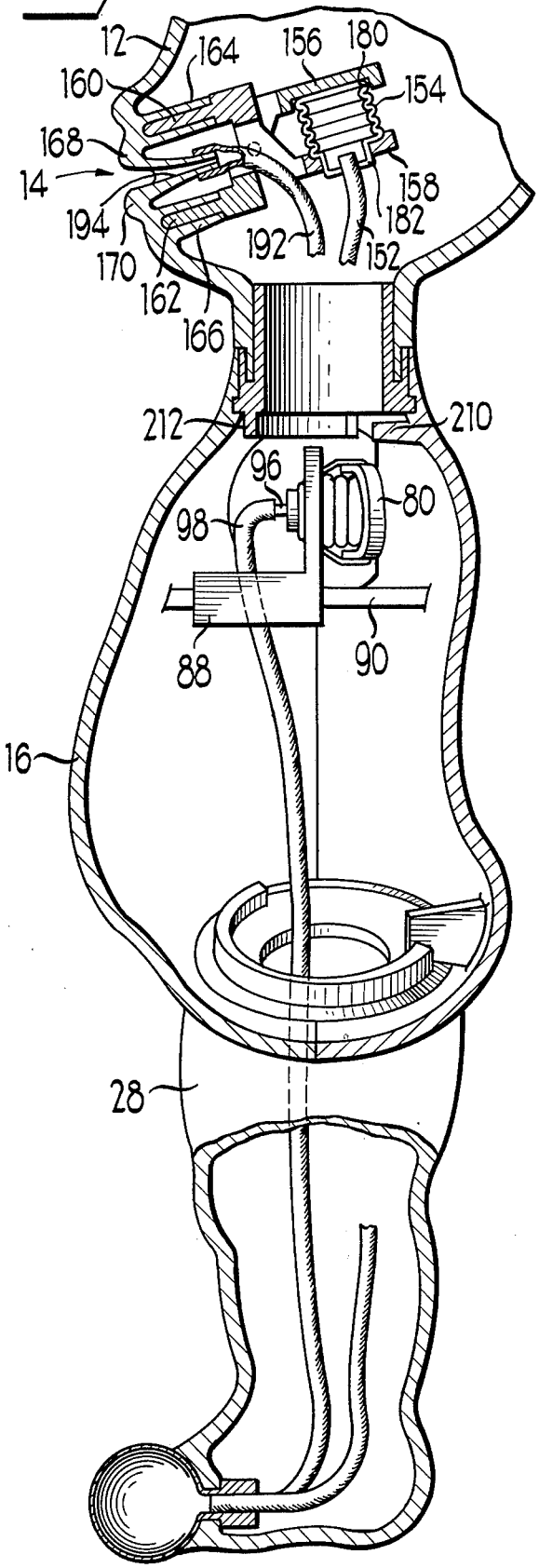
FIG. 3 is a fragmented cut-away vertical sectional view, on an enlarged scale, taken from the left side of the upstanding doll of FIG. 1 and generally along a vertical line through the center and along the length of the doll illustrating features of the right side of the doll.

The mouth or lip actuators 160 and 162 are formed as extending rods or pins of the pivotal elements and inserted into extending upper and lower lip sockets 164 and 166, FIG. 3, which are formed or molded with the mouth 14 of the doll. Each of the lip sockets 164 and 166 are connected to respective formed lip portions 168 and 170. The pivotal elements 156 and 158 are interconnected by the insertion of extending pins 172 and 174 of the lower element 158 into mating sockets or slots 176 and 178 respectively. As best seen in FIG. 3, the bellows 154 is positioned at one end into a recessed accepting portion 180 of the upper pivotal element 156 and at the other end a narrowed portion 182 of the bellows arrangement 158 extends through a circular passage 184 formed through the lower pivotal element 158.

When the squeeze bulb 150 is compressed, the bellows 154 expands to move the pivotal elements 156 and 158 apart by pivoting around the pivot pins 172 and 174. The lips 168 and 170 of the mouth 14 are spread apart or opened through respective mouth actuator rods 160 and 162 thereby simulating the opening of the mouth 14 of the doll. Upon relieving of the bulb 150, the lips 168 and 170 return to their normally semiclosed position so that alternate squeezing and relieving of the bulb causes opening and closing of the mouth to simulate talking or other lip movements.

Also positioned in the toe position of the left foot is another squeeze bulb 190 which is operatively connected through a conduit or conducting tube 192 to the spout of a central mouth opening 194. In accordance with an important aspect of the present invention, a mouth sucking or intake of fluids through the mouth opening 194 of the mouth 14 may be accomplished to simulate the drinking of liquids by the actual intake of liquid into the doll through the conduit 192 down to the squeeze bulb 190 and out through a liquid drain hole 196 after a siphoning effect has been created. In operation, a suitable baby bottle accessory filled with a fluid and having a nipple opening or other fluid containing vessel is held up to the doll's mouth 14 so as to present the nipple to the mouth receiving socket or passage 194. The bulb 90 is squeezed one or a number of times with the liquid drain hole 196 closed off until a siphoning action is created drawing the fluid out of the nipple of the bottle or other vessel. The liquid runs down the conducit 192 and into the squeeze bulb 190 whereupon the liquid drain 196 is uncovered to allow the liquid to drain out. In specific alternative embodiments, a conduit retaining vessel may be included in combination and in connection with the squeeze bulb 190 and the conduit 192 to retain a liquid for future disposal or emptying. It should also be understood that the squeeze bulb 190 is effective to intake or expel fluids for various simulation purposes.

In order to avoid excessive twisting of the conduits98, 116, 152 and 192, which might be caused by rotation of the legs 26 or 28 in either direction for multiple revolutions, leg stop tabs 200 and 202 for the right and left legs 26 and 28 respectively are provided as extending portions of the torso 16. The leg stop tabs 200 and 202 contact respective circumferential limiting ridges 204 and 206 which extend from the respective flanges 22 and 24 of the legs. The limit ridges 204 and 206 extend around or are located at a predetermined circumference of the flanges 22 and 24 or are located at predetermined circumferential paired positions to limit movement of the legs to the portion or number of degrees of circumference between the end stops of the ridges 204 and 206. Similarly to avoid excessive twisting of the conduits 152 and 192 that extend into the head of the doll, a neck stop arrangement is provided similar to the arrangements for the legs by the provision of a neck stop tab 210 which extends from the back of the torso 16. The neck stop tab 210 contacts the end stops or edges of an extending neck limiting ridge 212 upon rotation that exceeds a predetermined number of degrees or amount of rotation.

In specific embodiments, the squeeze bulbs 100, 114, 150 and 190 may be formed within closed foot portions of the doll or toes may be painted or otherwise formed on the squeeze bulbs to render the appearance of the feet of the doll as more nearly that of a human child.

The foregoing detailed description has been given for clearance of understanding only and no unnecessary limitations should be understood therefrom as some modifications will be obvious to those skilled in the art.

What is claimed is:

1. An articulated doll, comprising, a doll torso supporting a head and leg components;

a mouth defined on said head and including spaced apart lip members and a central defined mouth opening;

a first articulated arm with attached hand supported on said torso and including means for controlling rotational movement of said first arm to cause a hand raising and lowering motion;

actuating means disposed within the foot of one of said legs remote from said first arm controlling means and operatively associated therewith for effecting movement of said first arm;

a second articulated arm with attached hand supported on said torso and including means for controlling pivotal movement of said second arm to cause a side-to-side hand motion across said head;

actuating means disposed within the foot of one of said legs remote from said second arm controlling means and operatively associated therewith for effecting movement of said second arm;

means disposed within said head for controlling movement of said spaced apart lip members;

lip actuating means disposed within the foot of one of said legs remote from said lip movement controlling means and operatively associated therewith for effecting movement of said lip members; and mouth actuating means disposed within the foot of one of said legs remote from said mouth opening and operatively associated therewith for effecting the intake of fluids through said mouth opening.

2. The articulated doll of claim 1 wherein said first arm controlling means comprises a stationary control member supported on said torso, a movable rotary control member operatively coupled to said first arm and bellows means positioned between and supported by said stationary and movable control members.

3. The articulated doll of claim 2 wherein said first arm actuating means comprises an air bulb in communication with said bellows means for effecting movement of said first arm.

4. The articulated doll of claim 3 wherein said air bulb is located in the toe position of the foot of one of said legs.

5. The articulated doll of claim 2 wherein said first arm further includes an attached keyed shaft which is fixedly attached to and rotates with said movable control member, said movable control member including a key way receiver for attachment to said shaft.

6. The articulated doll of claim 1 wherein said second arm controlling means comprises a stationary control member supported on said torso, a pivotal control member operatively coupled to said second arm and pivotally supported by said torso, and bellow means positioned between said stationary and pivotal control members.

7. The articulated doll of claim 6 wherein said second arm actuating means comprises an air bulb in communication with said bellows means for effecting movement of said second arm.

8. The articulated doll of claim 7 wherein said air bulb is located in the toe position of the foot of one of said legs.

9. The articulated doll to claim 1 wherein said first and second arm actuating means are disposed within a first of said legs in the toe position of the foot, said lip actuating means and said mouth actuating means are disposed within a second of said legs in the toe position of the foot.

10. The articulated doll of claim 1 wherein said legs are rotatably attached to said torso, said torso including extending torso leg limit tabs, said legs including engaging edge surfaces which are positioned to contact said torso leg limit tabs when said legs are rotated beyond a predetermined degree in either direction with respect to a predetermined reference point on said torso.

11. The articulated doll of claim 1 wherein said head is rotatably attached to said torso, said torso including a head limit tab extending from said torso, said head including engaging edge surfaces which are positioned to contact said torso head limit tab when said head is rotated beyond a predetermined degree in either direction with respect to a predetermined reference point on said torso.

12. The articulated doll of claim 1 wherein said first and second arms are movable at their respective shoulder connection position on said torso and said first and second arm controlling means are positioned in said torso to form movable connections to said arm at the respective shoulder positions.

13. The articulated doll of claim 1 wherein said first and second arm actuating means are each disposed within one of said legs in the toe position of the foot, said lip actuating means and said mouth actuating means each being disposed within one of said legs in the toe position of the foot.

14. The articulated doll of claim 1 wherein said first arm actuating means and said second arm actuating means are respectively disposed within the toe position of the foot of the corresponding leg, said lip actuating means and said mouth actuating means each being disposed within one of said legs in the toe position of the foot.

15. An articulated doll, comprising:

a doll torso supporting head and leg components;

a mouth defined on said head and including spaced apart lip members and a central defined mouth opening;

means disposed within said head for controlling movement of said spaced apart lip members;

lip actuating means disposed within the foot of one of said leg components remote from said lip movement controlling means and operatively associated therewith for effecting movement of said lip members; and mouth actuating means disposed within the foot of one of said leg components remote from said mouth opening and operatively associated therewith for effecting the intake of fluids through said mouth opening, said spaced apart lip members each including a receiving socket formed within a portion of said lip members extending into said head, said lip controlling means comprising two interlocking pivotal members and bellows means positioned between said pivotal member at a first end opposite the pivotal point, each of said pivotal members including an extending pin at a second end opposite the pivotal point for engaging a respective one of said lip member receiving sockets.

16. The articulated doll of claim 15 wherein said lip actuating means comprises an air bulb in communication with said bellows means for effecting movement of said lip members.

17. The articulated doll of claim 16 wherein said air bulb is located in the toe position of the foot of one of said limbs.

18. The articulated doll of claim 15 wherein said mouth actuating means comprises an air bulb in communication with said defined mouth opening.

19. The articulated doll of claim 18 wherein said air bulb is located in the toe position of the foot of one of said limbs.

20. An articulated doll, comprising:

a doll torso supporting a head and leg components;

an articulated arm with attached hand supported on said torso and including means for controlling movement of said arm to cause a hand raising and lowering motion;

actuating means disposed within one of said legs remote from said arm controlling means and operatively associated therewith for effecting movement of said arm;

a mouth defined on said head and including spaced apart lip members;

means disposed within said head for controlling movement of said spaced apart lip members;

lip actuating means disposed within one of said legs remote from said lip movement controlling means and operatively associated therewith for effecting movement of said lip members; and a telephone handset accessory designed to be retained in said attached hand, said arm being positioned to simulate the answering of a telephone upon operation of said arm actuating means.

21. An articulated doll, comprising:

a doll torso supporting a head and leg components;

an articulated arm with attached hand supported on said torso and including means for controlling pivotal movement of said arm to cause a side-to-side hand motion across said head;

actuating means disposed within one of said legs remote from said arm controlling means and operativelyassociated therewith for effecting movement of said arm;

a mouth defined on said head and including a central defined mouth opening;

mouth actuating means disposed within one of said legs remote from said mouth opening and operatively associated therewith for effecting the intake or outflow of fluids through said mouth opening; and a toothbrush accessory designed to be retained in said attached hand, said arm being positioned to simultate the brushing of teeth upon operation of said arm actuating means.

22. An articulated doll, comprising:

a doll torso supporting a head and leg components;

a first articulated arm with attached hand supported on said torso and including means for controlling rotational movement of said first arm to cause a hand raising and lowering motion;

actuating means disposed within one of said legs remote from said first arm controlling means and operatively associated therewith for effecting movement of said first arm;

a second articulated arm with attached hand supported on said torso and including means for controlling pivotal movement of said second arm to cause a side-to-side hand motion across said head; and actuating means disposed within one of said legs remote from said second arm controlling means and operatively associated therewith for effecting movement of said second arm;

said first arm further including an attached keyed shaft which is fixedly attached to and rotates with said movable control member, said movable control member including a key way receiver for attachment to said shaft;

said first arm controlling means comprising a stationary control member supported on said torso, a movable rotary control member operatively coupled to said first arm and bellows means positioned between and supported by said stationary and movable control members.

23. An articulated doll, comprising:

a doll torso supporting a head and leg components;

a mouth defined on said head and including spaced apart lip members and a central defined mouth opening;

a first articulated arm with attached hand supported on said torso and including means for controlling rotational movement of said first arm to cause a hand raising and lowering motion;

actuating means disposed within the foot of one of said legs remote from said first arm controlling means and operatively associated therewith for effecting movement of said first arm;

a second articulated arm with attached hand supported on said torso and including means for controlling pivotal movement of said second arm to cause a side-to-side hand motion across said head;

actuating means disposed within the foot of one of said legs remote from said second arm controlling means and operatively associated therewith for effecting movement of said second arm;

means disposed within said head for controlling movement of said spaced apart lip members;

lip actuating means disposed within the foot of one of said legs remote from said lip movement controlling means and operatively associated therewith for effecting movement of said lip members; and mouth actuating means disposed within the foot of one of said legs remote from said mouth opening and operatively associated therewith for effecting the intake of fluids through said mouth opening, said first and second arm actuating means being disposed within a first of said legs in the toe position of the foot, said lip actuating means and said mouth actuating means being disposed within a second of said legs in the toe position of the foot.

* * * * *